United States Patent [19]

Jordan et al.

[11] Patent Number: 4,749,218

[45] Date of Patent: Jun. 7, 1988

[54] MAGNETIC SAFETY CHAIN HOLDER

[76] Inventors: Richard L. Jordan, 13700 Tahiti Way No. 341, Marina Del Rey, Calif. 90291; Doris M. Lazar, 3090 Dublin Dr., San Francisco, Calif. 94080

[21] Appl. No.: 61,466

[22] Filed: Jun. 15, 1985

Related U.S. Application Data

[63] Continuation-in-part of Ser. No. 859,797, Jun. 30, 1986, abandoned.

[51] Int. Cl.[4] ..... E05C 17/36

[52] U.S. Cl. ..... 292/264

[58] Field of Search ..... 292/264, 251.5, 262, 292/DIG. 46, 339, DIG. 15

[56] References Cited

U.S. PATENT DOCUMENTS

| | | | |
|---|---|---|---|
| 1,824,045 | 9/1931 | Fetyh | 292/264 |
| 3,191,106 | 6/1965 | Baermann | 335/303 X |
| 3,471,189 | 10/1969 | Ness | 292/DIG. 46 X |
| 3,483,494 | 12/1969 | Cromie | 335/303 |
| 3,698,754 | 10/1972 | Mean | 292/DIG. 46 X |
| 3,727,658 | 7/1973 | Eldridge | 335/303 X |
| 3,873,954 | 3/1975 | Baermann | 335/303 |
| 3,950,019 | 4/1976 | Dugan | 292/264 |
| 4,058,335 | 11/1977 | Obe | 292/251.5 |
| 4,136,899 | 1/1979 | Frasher | 292/338 |

*Primary Examiner*—Richard E. Moore

*Attorney, Agent, or Firm*—William H. Maxwell

[57] ABSTRACT

A magnetic chain and bolt holder for a chain door guard, to prevent swinging thereof into damaging interference between the door and door casing, and comprised of a magnet plate positioned on the door casing at the terminal end of the chain when hanging by gravity for automatic securement thereof.

10 Claims, 1 Drawing Sheet

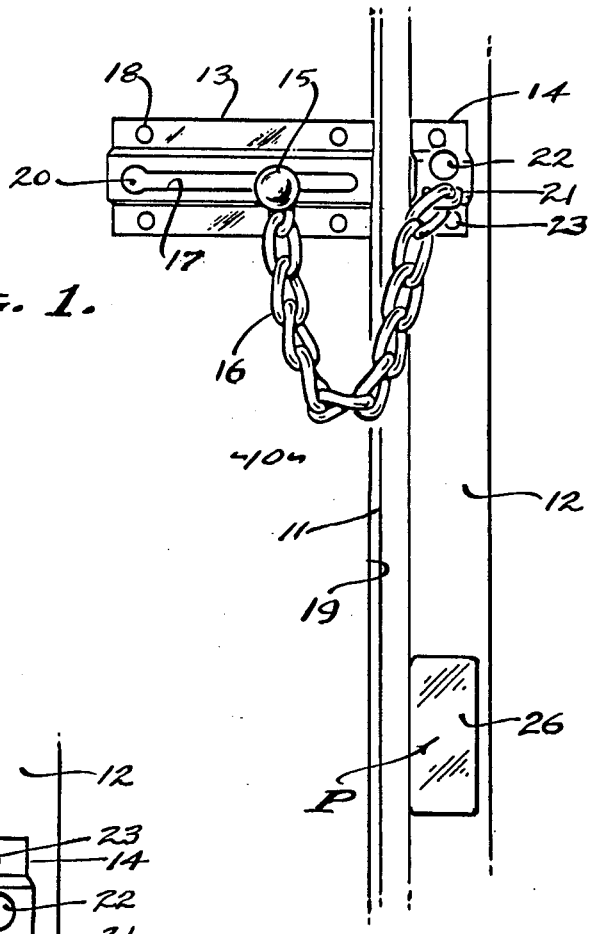
FIG. 1.
FIG. 2.
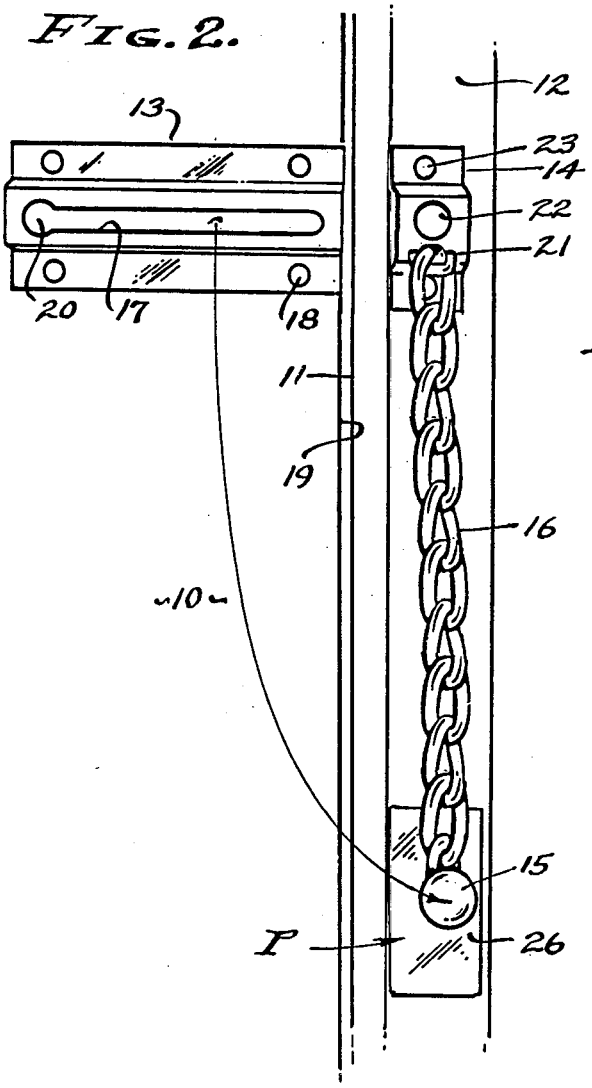
FIG. 3.
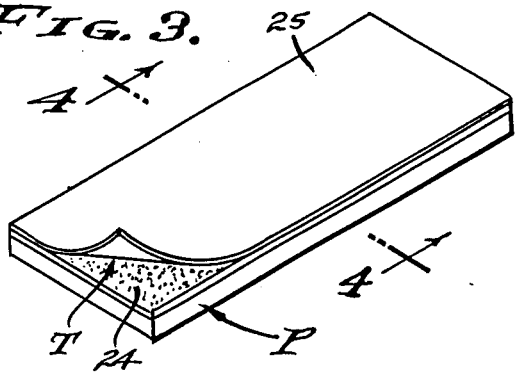
FIG. 4.
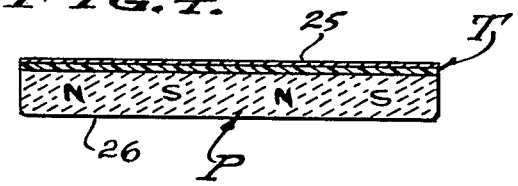

MAGNETIC SAFETY CHAIN HOLDER

This is a continuation in part of application Ser. No. 859,797 filed June 30, 1986 entitled MAGNETIC SAFETY CHAIN HOLDER, now abandoned.

BACKGROUND OF THE INVENTION

This invention retlates to a chain door guard, such as those used to secure a door in its shut or latched condition and from the inside of a buidling or compartment. These door guards are characterized by a door plate fastened to the inside of the door adjacent to a chain plate fastened to the inside of the door casing. A safety chain is anchored to the chain plate and normally depends therefrom when the door is unlatched or in use, there being a slide bolt at the terminal end of the chain. The door plate has a slide, usually a key-hole slot into which the slide bolt is inserted and captured, in order to secure the door in a latched condition, where it is normally held by the usual door lock set and locked for securety. A feature of such chain door guards is the provision of an opening in the chain plate to hang the slide bolt and safety chain , so that they will not swing into and interfere with closing of the door. However, people do not appreciate or take advantage of this chain plate opening feature and permit the slide bolt and safety chain to swing loose from said plate. Consequently, people passing through the door opening constantly brush against the loose slide bolt and safety chain causing them to swing into the door opening during the time period when the door is being closed, usually slammed shut. As a result, the door and door casing are damaged, whether wooden or metal, and especially in hotel and motel establishments where the people are irresponsible and careless.

It is an object of this invention to secure the slide bolt and safety chain of a chain door guard, whereby the slide bolt and safety chain are precluded from swinging into the door opening when separated from the door plate and permitted to swing loose from the chain plate.

It is another object of this invention to inherently secure the depending slide bolt and safety chain to the door casing when released from the door plate, to prevent them from swinging into the door opening when brushed by people passing through the door opening.

It is still another object of this invention to advantageously employ a magnet to automatically secure the depending slide bolt and safety chain when they are released from the door plate. In practice, chain door guards are metallic, the inexpensive guards being made of iron or steel, and the more expensive guards being made of solid brass but with plated steel slide bolts and safety chains for strength. Accordingly, the ferrous slide bolt and safety chain are attracted to the magnet employed here to secure them in a natural depending position where they are drawn by gravity.

The foregoing and various other objects and features of this invention will be apparent and fully understood from the following detailed description of the typical preferred forms and applications thereof, throughout which description reference is made to the accompanying drawings.

THE DRAWINGS

FIG. 1. is an elevational view showing a portion of the inside of a door closed to a casing and secured by a typical chain door guard.

FIG. 2 is a view similar to FIG. 1 and shows the chain door guard released and automatically secured by the magnetic safety chain holder of the present invention.

FIG. 3 is perspective view of the magnetic safety chain holder.

And, FIG. 4 is an enlarged sectional view of the safety chain holder taken as indicated by line 4—4 on FIG. 3.

PREFERRED EMBODIMENT

The Magnetic Safety Chain Holder is comprised of a magnetic plate P placed strategically with respect to a chain door guard so as to automatically intercept and secure the safety chain thereof when it is released. Additionally, the slide bolt thereof is also automatically intercepted and secured. A characteristic feature of chain door guards is that the bolt and chain swing down to be disposed loosely by gravity when released from the door plate thereof. The significance of this is that the loose bolt and chain often damage the door casing, do to the carelessness of people passing through the door and slamming the same with the bolt and chain in the way.

Referring now to the drawings, the door 10 is shown closed against a door casing 11 or molding 12. The chain door guard is comprised of a door plate 13 fastened to the door and a chain plate 14 fastened to the casing or molding, and a slide bolt 15 anchored to the chain plate by a safety chain 16.

The door plate 13 is an elongated member characterized by a slide 17 preferably in the form of a slot substantially coextensive with the plate, and mounted on the door as by means of screw fasteners 18. The slide 17 or slot is usually horizontal and extends away from the edge 19 of the door and where it is open to receive the slide bolt. In practice, the remote open end of the slide 17 or slot is by means of an enlarged key-hole opening 20.

The chain plate 14 is of a size and shape to fit onto the door casing 11 or molding 12 and is characterized by an anchor 21 to hold the safety chain 16 and an opening 22 to receive the chain, and mounted on the casing or molding as by means of screw fasteners 23. However, the opening 22 is seldom if ever and not always used! As shown, the chain plate 14 is aligned horizontally with the door plate 13.

The slide bolt 15 is a button-shaped part adapted to be inserted into the remote open end of the slide 17 or slot and captured thereby when moved toward the door edge 19. In practice, the slide bolt is grooved (not shown) in order to be slideable in the slot (17).

The safety chain 11 is a chain of interconnected twisted links (as shown) in order to hand flat without entanglement, and it is permanently attached to both the anchor 21 and to the slide bolt as is clearly indicated in the drawings.

Either and preferably both the slide bolt 15 and safety chain 16 are of ferrous material or metal, and preferably of steel for durability.

Referring now to the magnetic plate P, a preferred type of plate is shown and will now be described. However, it is to be understood that any kind of magnet plate can be used; metallic, ceramic, rubberized, plastic, or any body which can be made magnetic, including electrically energized magnets. The preferred form of magnet used herein is of ceramic that is permanently magnetized. As shown, the magnetic plate P is a flat and/or thin rectangle of magnetic ceramic made according to the present state of the art, which can be a mixture of granular permanent magnet material in a binder of solid ceramic. Separate portions of the plate are polarized magnetically to be North and South as indicated in FIG. 4, whereby the entire surface of plate P attracts ferrous objects, especially the slide bolt 15 and terminal end of the safety chain 16 (see FIG. 4).

The magnetic plate P is positioned on the door casing 11 or molding 12, or on the wall adjacent to the door edge 19, to be at the terminal end of safety chain 16 to attract it and the slide bolt 15 attached thereto. As clearly shown by the arrow in Fig.2, the slide bolt inherently drops to a vertical position directly beneath the chain plate 14 when released from the door plate 13, and in this position the bolt and chain overly the magnetic plate P to be automatically attracted thereby and secured thereto. Thus, the slide bolt 15 and safety chain 16 are precluded from entering into the door opening.

The preferred attachment of the magnetic plate P to the door casing 11 or molding 12 is by means of double-sided pressure sensitive tape T having adhesive qualities at both its front and back faces. As shown, the tape T is coextensive with the back side of the magnetic plate P and is permanently adhered thereto. The front side 24 of the tape T is protected by a removable film 25, so as to be exposed for adherence to the casing or molding as shown, thereby exposing the front side 26 of the plate P to attract the slide bolt 15 and terminal end of the safety chain 16.

From the foregoing it will be seen that we have provided an effective and very practical combination of a chain door guard and magnetic satefy chain holder. By placing the magnetic plate as specified herein, the slide bolt and safety chain are inherently attracted into a secure position so as to automatically preclude damage to the door and door casing, even under adverse circumstances when careless people brush thereagainst.

Having described only the typical preferred forms and application of our invention, we do not wish to be limited or restricted to the specific details herein set forth, but wish to reserve to ourselves any modifications or variations that may appear to those skilled in the art as set forth within the limits of the following claims.

We claim:

1. A chain holder in combination with a chain door guard comprised of a door plate fastened to a door to releasably hold a chain and a chain plate fastened to a door casing in alignment with the door plate and to which the chain is anchored to hang by gravity when released from the door plate, the chain being of magnetically attractable material, and the chain holder including, a magnet plate positioned on the door casing at the terminal end of the chain when hanging from the chain plate for its securement and to prevent swinging thereof into damaging interference between the door and casing.

2. The chain holder in combination with a chain door guard as set forth in claim 1, wherein the magnet plate is a flat rectangle fastened onto the door casing.

3. The chain holder in combination with a chain door guard as set forth in claim 1, wherein the magnet plate is a flat retangular ceramic body with magnetized material permanently polarized to hold the magnetically attractable chain material.

4. The chain holder in combination with a chain door guard as set forth in claim 1, wherein the magnet plate is flat with a coextensive layer of double sided pressure sensitive tape for fastening thereof onto the door casing.

5. The chain holder in combination with a chain door guard as set forth in claim 1, wherein the magnet plate is a flat rectangular ceramic with magnetized material permanently polarized to hold the magnetically attractable chain material,and with a coextensive layer of double sided pressure sensitive tape for fastening thereof onto the door casing.

6. A chain and bolt holder in combination with a chain door guard comprised of a door plate fastened to a door to releasably hold a bolt at the terminal end of a chain and a chain plate fastened to a door casing in alignment with the door casing and to which the chain is anchored to hang by gravity when the bolt is released from the door plate, at least the chain or bolt being of magnetically attractable material, and th chain holder including, a magnet plate positioned on the door casing at the terminal end of the chain and at the bolt hanging from the chain plate for their securement and to prevent swinging thereof into damaging interference between the door and casing.

7. The chain and bolt holder in combination with a chain door guard as set forth in claim 6,wherein the magnet plate is a flat rectangle fastened onto the door casing.

8. The chain and bolt holder in combination with a chain door guard as set forth in claim 6, wherein the magnet plate is a flat retangular ceramic body with magnetized material permanently polarized to hold the magnetically attractable chain material.

9. The chain and bolt holder in combination with a chain door guard as set forth in claim 6, wherein the magnet plate is flat with a coextensive layer of double sided pressure sensitive tape for fastening thereof onto the door casing.

10. The chain and bolt holder in combination with a chain door guard as set forth in claim 6, wherein the magnet plate is a flat rectangular ceramic with magnetized material permanently polarized to hold the magnetically attractable chain material, and with a coextensive layer of double sided pressure sensitive tape for fastening thereof onto the door casing.

* * * * *